US005154656A

United States Patent [19]

Milstein

[11] Patent Number: 5,154,656

[45] Date of Patent: Oct. 13, 1992

[54] MULTI-CONNECTING BUILDING BLOCKS

[76] Inventor: Linda Milstein, 35 Prospect Park West, Apt. 4-D, Brooklyn, N.Y. 11215

[21] Appl. No.: 697,798

[22] Filed: May 9, 1991

[51] Int. Cl.[5] ..... A63H 33/06; A63H 33/08; G09B 19/00

[52] U.S. Cl. ..... 446/120; 446/125; 446/110; 434/259

[58] Field of Search ..... 446/120, 121, 122, 123, 446/124, 125, 126, 127, 118, 117, 116, 115, 112, 111, 110, 109, 108; 434/258, 259, 403

[56] References Cited

U.S. PATENT DOCUMENTS

| | | | |
|---|---|---|---|
| 1,580,285 | 4/1926 | Carlson | 446/110 |
| 2,565,823 | 8/1951 | Pool . | |
| 2,623,303 | 12/1952 | Mindel | 434/259 |
| 2,780,028 | 2/1957 | McNeill | 446/110 X |
| 3,389,493 | 6/1968 | Zysset | 446/124 |
| 3,496,670 | 2/1970 | Sloop et al. | 446/124 X |
| 3,561,757 | 2/1971 | Schillig | 434/403 X |
| 3,577,671 | 5/1971 | Woollett | 446/124 |
| 3,640,018 | 2/1972 | Light . | |
| 3,698,122 | 10/1972 | Adams | 446/118 |
| 3,993,313 | 11/1976 | Tillotson | 446/125 X |
| 4,003,144 | 1/1977 | Maddestra et al. | 446/122 X |
| 4,160,337 | 7/1979 | Fisher . | |
| 4,698,023 | 10/1987 | Marino . | |

FOREIGN PATENT DOCUMENTS

| | | | |
|---|---|---|---|
| 0379389 | 7/1990 | European Pat. Off. | 446/125 |
| 2231502 | 11/1990 | United Kingdom | 446/125 |

*Primary Examiner*—David N. Muir
*Attorney, Agent, or Firm*—Darby & Darby

[57] ABSTRACT

Children's building blocks that can be attached to each other in numerous combinations by integrally molded connectors located on the faces of the blocks. Some of the faces have apertures and these faces may be joined together to create tunnels between the interiors of two adjacent blocks. Doors are also provided to selectively cover the apertures. Faces having apertures may be connected to faces without apertures for the child to distinguish between an open connection and a closed connection.

12 Claims, 2 Drawing Sheets

MULTI-CONNECTING BUILDING BLOCKS

BACKGROUND OF THE INVENTION

This invention relates to children's building blocks. The invention specifically provides generally cubic blocks with an aperture in at least one of the faces and connecting means for detachably connecting blocks together. The invention also provides for door structures pivotably attached to the blocks and door attachment means on the blocks for detachably securing the doors to the blocks.

FIELD OF THE INVENTION

Children's building blocks of the solid cube type, are well known in the art. Connectable building blocks are also shown in the art, e.g. U.S. Pat. Nos. 3,577,671, 4,698,023 and 2,565,823.

In the arrangements illustrated in these patents and others in the art, the blocks can be connected by a variety of means, but are then simply connected to each other. In essence, a larger block is created. The child is still limited to the outside of the blocks, or perhaps the inside of one block at a time. The child cannot explore the interrelation of the blocks after connection, as there is a wall between them. Also, once a particular structure is built, the child's imagination is again limited to the outer surface of one larger, possibly irregular shaped, aggregate block for enjoyment. If the interiors of the blocks are accessible, only one can be accessed at a time; the interiors are not interconnected.

U.S. Pat. No. 4,003,144 discloses an educational block that can be connected to similar blocks by means of a "replaceable" chip. The faces of the block are provided with a circular aperture intended to receive a rod. One variety of the replaceable chip also includes a circular aperture meant to receive a rod. However, these apertures are too small to allow the child to explore the connection, as that was not their intention. The replaceable chip, which is also disclosed without the rod-receiving hole, can be easily lost and thus make connection of the blocks impossible.

SUMMARY OF THE INVENTION

In view of these deficiencies in the existing types of children's building blocks, it is an object of the invention to provide an improved connectable building block that allows communication between the internal spaces of the blocks.

It is another object of the invention to provide a connectable building block where the connection means is integral with the block.

It is a further object of the invention to provide a children's building block that by its interconnectivity, introduces the concepts of volume, space, and basic structural relationships to infants, toddlers, and school-age children.

It is a further object of the invention to provide children's building blocks that are easily and economically manufactured.

In accordance with my invention, a hollow cubic block is provided with at least one face having an aperture for access to the internal space of the block. At a portion of the edge of each aperture is a connecting means for detachably connecting two blocks to each other. The connecting means engages a complementary receiving means on a portion of the edge of an aperture on another block. The two mated apertures have a similar shape, thus forming a brief tunnel between the two blocks. A holder may also be used with a plurality of blocks according to the invention.

The foregoing and other objects and advantages of the invention will become apparent to those skilled in the art upon reading the following detailed description of a preferred embodiment, along with the appended drawings.

DETAILED DESCRIPTION

Figure 2:
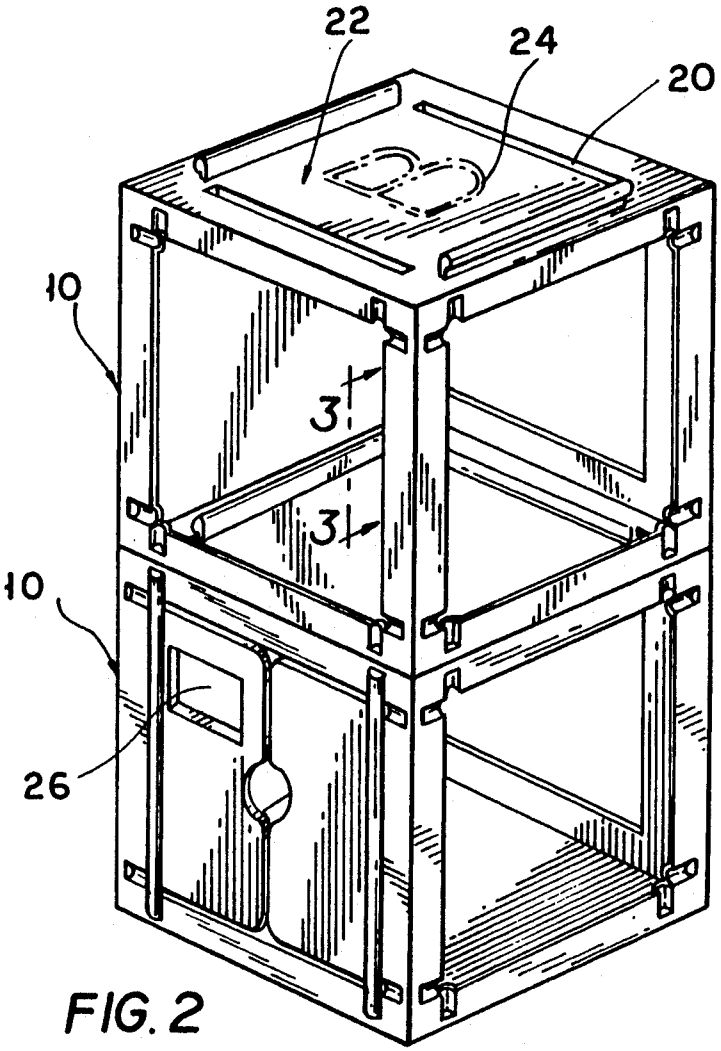
FIG. 2 is a perspective view of two building blocks connected according to the invention.
Figure 1:
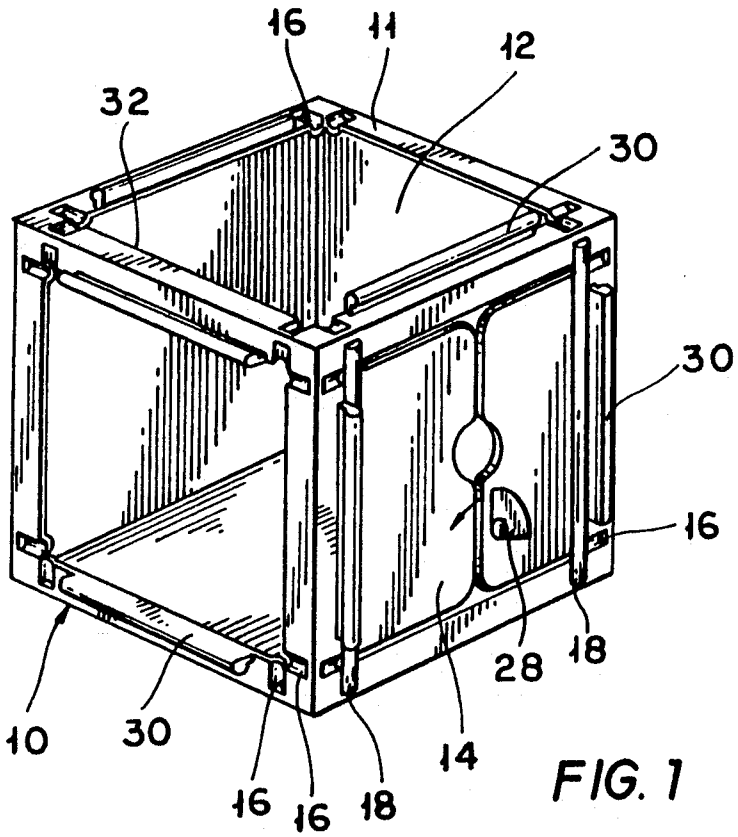
FIG. 1 is a perspective view of a building block according to the invention.
Figure 4:
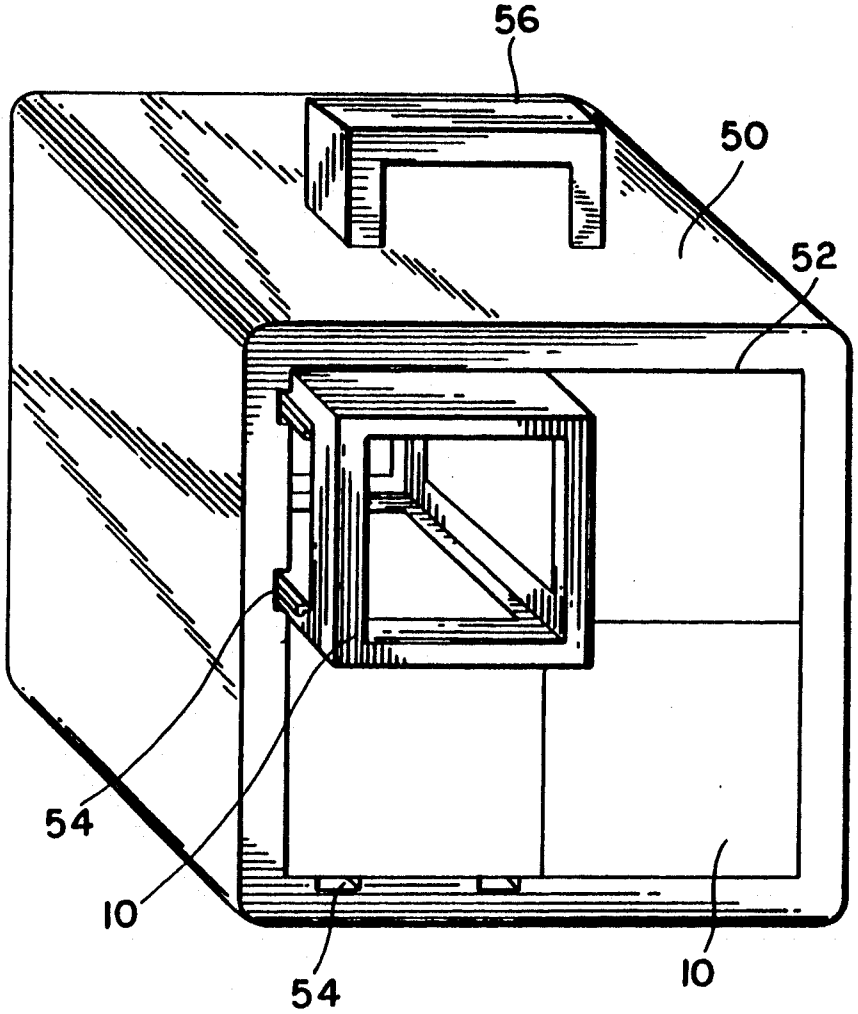
FIG. 4 is a perspective view of a building block holder according to the invention.
Figure 3:
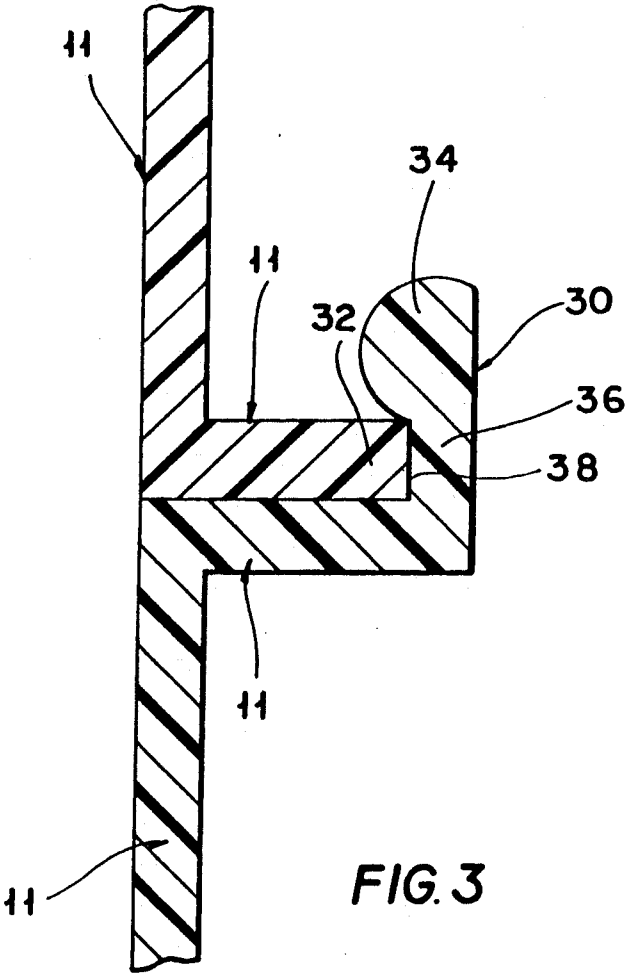
FIG. 3 is a detail cross-section view of a connector according to the invention.

Referring now to the drawings, a preferred embodiment of my invention includes a block 10, having a generally cubic shape, which has six faces 11 and is formed of a durable, semirigid plastic. Suitable plastic materials include, by way of non-limiting example, polypropylene, polyethylene, and nylon. At least one of these faces 11 has an aperture 12, preferably of a square shape and large enough for small objects or a child's hand to pass through. On two opposing sides of each aperture 12 is a raised connector 30 extending outwardly from the face 11. Along the edge of each aperture 12, immediately adjacent to each corner of the aperture 12, extending at right angles therefrom are two hinge recesses 16, each for pivotably receiving a corresponding tab 18 in a door 14. The door 14 is designed to cover an aperture 12 alone, or in combination with another door 14. Each door 14 has two tabs 18 extending from the sides of the door 14 along the axis of rotation of the door 14. The inner shape of hinge recess 16 is a curve containing slightly more than a half circle, so that the tabs 18 can be snapped into the hinge recess 16 for pivotable engagement therewith. By placing door recesses 16 on all four sides of each aperture 12, a door 14 may be mounted on any side in any orientation. When two doors 14 are used to cover one aperture 12, they may be molded with engaging means for a snap-fit closure, or provided with a locking means as described below.

At each edge of an aperture 12 without a connector 30 is a lip 32. The connector 30 is comprised of a stem 36 that extends perpendicular from face 11 and a semicylindrical protrusion 34 at the end of the stem 36, running the length of the connector 30. The protrusion 34 projects toward the outer edge of face 11, forming a detent 38 for receiving lip 32. The connector 30 is preferably made of a resilient material, such that when two blocks 10 with similar apertures 12 are pushed together, the four lips 32, two on each block, will contact the opposing protrusions 34, moving the protrusions 34 and the ends of the stems 36 toward the center of the faces 11. The lip 32 will then slip into detent 38 and the protrusion 34 will return to its original position, holding lip 32 within detent 38. The blocks 10 are now engaged with two apertures 12 facing each other. Objects can now pass from one block 10 to the other and children may explore via sight and touch the interrelation of the blocks. Objects may be passed through, such as conventional toy figurines, or the child may reach through to place or grab an object from an adjacent, connected block.

To detach two blocks, simple pressure is exerted perpendicular to and away from the adjoining faces 11. Lip 32 will leave detent 38 by exerting pressure on protrusion 34 toward the center of face 11. Lip 32 will then slip by connecter 30 and the blocks 10 will be detached. Several blocks 10 may be connected, although each pair of blocks 10 with facing apertures 12 will be connected in the same manner.

Closed faces 22 of the blocks 10 do not have apertures 12 but instead have two connector slots 20 for receiving connectors 30 from another block 10. The closed faces also have two connectors 30 extending perpendicular to the closed face 22, positioned to snap-fit with a corresponding lip 32 of an opposing face 11 or a closed face 22. When a closed face 22 is attached to an apertured face 11, no connection is made between the interiors of the two blocks 10, as when two apertured faces 11 are attached. This is intended for the child to distinguish between an open connection between two blocks and a blocked connection.

Any combination of apertured faces 11 and closed faces 22 is contemplated by this invention and allows for a range of complexity of the blocks, allowing for their use by infants to school-age children. The blocks 10 can be any color including multi-colors and may have any appropriate indicia 24, such as letters or numbers on a closed face 22 and/or door 14. The doors 14 can also contain door holes 26 of any shape to enhance the child's awareness of inside and outside.

Door-opening means 28 may be integrally molded with the door or may be attached. Examples of door opening means 28 are small knobs, fat knobs, handles, or various geometrically shaped door holes 26. Locking means may also be added to the door, such as a slidably mounted lock for engaging an edge of an aperture 12, or a rotating or pivoting arm for engaging the edge. When two doors 14 are used on one aperture 12, each may be provided with a door-opening means or a door locking means between the two doors 14.

Due to the symmetrical connecting system of the blocks 10, an infinite number of structures with access to both the exterior and the interior of the completed structure is possible. For example, the blocks 10 may be used to build a castle wall and a building inside (not shown). The child may then use the space formed with the wall and the interior of the building, as well as the interior of the blocks, to continue to play using known playing figures, such as soldiers and the like.

The invention additionally provides for a holder 50 designed to detachably hold a plurality of blocks 10, preferably four, to create a toy structure, controlled by a parent for children that are too young to connect the blocks 10. The holder 50 is preferably a rectangular prism having rounded outer corners for child safety and is formed of a similar material to the blocks. A block-receiving cut-out 52 is dimensioned to receive a predetermined number of blocks 10 in this embodiment, 4. Along the inner edge of the cut-out 52 are slots 54 to receive the connectors 30 of the blocks 10. The cut-out 52 is also dimensioned for a close fit when all four blocks 10 are inserted. This causes the blocks 10 to remain in the holder 50. A handle 56 may also be provided on the holder 50.

While the embodiments of the invention shown and described is fully capable of achieving the results desired, it is to be understood that these embodiments have been shown and described for purposes of illustration only and not for purposes of limitation.

What is claimed is:

1. Toy building blocks comprising:

at least two blocks, each of the blocks having a plurality of faces, the faces defining an internal space, each of the blocks having an aperture on at least one face, each of said apertures having at least one edge;

at least one connecting means for detachably connecting one of the blocks to the other of the blocks, a connecting means integrally molded to each of the blocks along said one edge of said aperture;

at least one receiving means for detachably receiving the connecting means, a receiving means integrally molded to each of the blocks on at least one face having an aperture such that when the blocks are connected, physical communication between the internal space of the two blocks is possible.

2. Toy building blocks as in claim 1, wherein the connecting means extends from the face of the block and is comprised of a stem, the stem extending perpendicular from the face, and a semi-cylindrical protrusion at the distal end of the stem, the protrusion forming a detent for receiving the receiving means.

3. Toy building blocks as in claim 2, wherein the receiving means on each face without an aperture is at least one groove in the face, positioned and dimensioned to receive a complementary connecting means on another block.

4. Toy building blocks as in claim 3, wherein the receiving means on each face with an aperture is comprised of the edges of the sides of the aperture without connecting means.

5. Toy building blocks as in claim 1, wherein the blocks are formed of a semi-rigid material.

6. Toy building blocks as in claim 1, wherein the apertures are rectangular and are sized such that a child's hand may pass through the apertures.

7. Toy building blocks as in claim 6, wherein the blocks further comprise at least one door and each aperture has a plurality of hinge recesses for pivotably receiving at least one door in at least two orientations being at right angles to each other, each door having an open position and a closed position.

8. Toy building blocks as in claim 7, wherein the doors further comprise door opening means extending from at least one of the doors for facilitating the manipulation of the doors between the closed position and the open position.

9. Toy building blocks as in claim 7, wherein the doors further comprise locking means having a first position and a second position, such that when the locking means is in the first position, the door will not pivot from the closed position to the open position and when the locking means is in the second position, the door will pivot upon manipulation of the door.

10. Toy building blocks as in claim 1, further comprising a frame for detachably holding the blocks, the frame having a plurality of integrally molded slots for receiving the connecting means and detachably retaining the blocks.

11. Toy building blocks comprising:

at least two blocks, each of the blocks having a plurality of faces, the faces defining an internal space, and each of the blocks having a rectangular aperture on at least one face, the apertures being sized such that a child's hand may pass therethrough;

at least one connecting means for detachably connecting one of the blocks to the other of the blocks and being integrally molded to each of the blocks on at least one face having an aperture;

at least one receiving means for detachably receiving the connecting means, a receiving means being integrally molded to each of the blocks on at least one face having an aperture such that when the blocks are connected physical connection between the internal space of the two blocks is possible; and at least one door having hinge pivots extending therefrom, each aperture having a pair of hinge recesses positioned at each side of each aperture for pivotably receiving the door hinge pivots, the apertures being sized to receive the door in either orthoganol direction and the hinge recesses being placed to receive the door hinge pivots in either orientation. each door having an open and a closed position.

12. Toy building blocks as in claim 11, wherein when two of said at least one doors are pivotably attached to respective pairs of hinge recesses, an engaging means is provided at the adjacent edges of said two doors such that when said two doors are in the closed position, said doors can only be pivoted to the open position by manipulation of said doors.

* * * * *